US005963579A

United States Patent [19]

Henryon

[11] Patent Number: 5,963,579

[45] Date of Patent: Oct. 5, 1999

[54] METHOD OF HEATING A MOLTEN METAL IN A CONTINUOUS CASTING TUNDISH USING A PLASMA TORCH, AND TUNDISH FOR ITS IMPLEMENTATION

[75] Inventor: Michel Henryon, Morfontaine, France

[73] Assignee: Sollac, Puteaux, France

[21] Appl. No.: 09/132,515

[22] Filed: Aug. 11, 1998

[30] Foreign Application Priority Data

Aug. 11, 1997 [FR] France ..... 97 10307

[51] Int. Cl.[6] ..... H05B 7/00

[52] U.S. Cl. ..... 373/18; 373/22; 266/229

[58] Field of Search ..... 373/18, 19, 22, 373/24; 266/229, 236, 275

[56] References Cited

U.S. PATENT DOCUMENTS

| | | | |
|---|---|---|---|
| 5,226,949 | 7/1993 | Schlienger | 75/377 |
| 5,272,718 | 12/1993 | Stenzel et al. | 373/22 |
| 5,662,862 | 9/1997 | Braud et al. | 266/229 |
| 5,785,923 | 7/1998 | Surma et al. | 266/144 |

FOREIGN PATENT DOCUMENTS

| | | |
|---|---|---|
| 0 453 188 | 10/1991 | European Pat. Off. . |
| 95 32069 | 11/1995 | WIPO . |

OTHER PUBLICATIONS

Patent Abstracts of Japan; Hasegawa Teruyuki; Tundish With Heating Device; JP 03 138052 A (NKK Corp), Jun. 12, 1991.

Patent Abstracts of Japan; Kondo Hirokazu; Method and Apparatus for Continuously Casting Steel, JP 03 285745 A (NKK Corp), Dec. 16, 1991.

Patent Abstracts of Japan; Mure Hiroshi; Ignition Method in Plasma Arc Heating; JP 59 110741 A (Shin Nippon Seitetsu KK), Jun. 26, 1984.

*Primary Examiner*—Tu Ba Hoang

*Attorney, Agent, or Firm*—Oblon, Spivak, McClelland, Maier & Neustadt, P.C.

[57] ABSTRACT

Method of heating molten metal in a tundish by irradiating a plasma torch on molten metal flowing along an internal surface of a heating compartment, and tundish configured for such method.

5 Claims, 3 Drawing Sheets

METHOD OF HEATING A MOLTEN METAL IN A CONTINUOUS CASTING TUNDISH USING A PLASMA TORCH, AND TUNDISH FOR ITS IMPLEMENTATION

FIELD OF THE INVENTION

The invention concerns the field of continuous casting of metals such as steel. More precisely it concerns continuous casting machines that comprise a plasma torch designed to heat the metal while it is in the tundish.

DISCUSSION OF THE BACKGROUND

In continuous casting, the molten steel contained in the casting ladle, where its composition has been adjusted, does not flow directly into the bottomless, cooled wall mould(s) where it begins to solidify. First it passes through a container called a "tundish", with an inner refractory lining, which has a number of functions. First, the bottom of the tundish contains one or generally several orifices called "nozzles", each overhanging a mould, which enables it to distribute the molten metal into the moulds, while the casting ladle has only one orifice through which the metal flows. In addition, the tundish provides a reserve of metal which makes it possible, when a ladle becomes empty, to continue casting the metal while the empty ladle is removed and a new ladle is installed and opened. In this way it is possible to cast several successive ladles without interruption (this is known as "sequence casting"). Finally, the tundish provides an advantageous site for undesirable non-metallic inclusions present in the molten steel to settle out, the benefit increasing the longer the metal remains in the tundish.

Some continuous casting installations include a facility for acting on the temperature of the molten steel using a heating device. This action can make it possible:

- to decrease the amplitude of the variations in temperature of the molten steel leaving the tundish during casting: a ladle generally takes several tens of minutes to empty and during this period the molten steel that it contains can lose several tens of degrees; heat input to the tundish, particularly at the end of casting, makes it possible to compensate at least partly for these losses of heat, so as to limit the variations in temperature of the metal leaving the tundish within a range of a few degrees throughout the casting period;
- to reduce the required temperature of the metal during its earlier treatment stages, thereby increasing the productivity of the foundry (the periods of heating the metal during treatment in the converter, the electric furnace or the ladle furnace can be reduced) and achieving savings on the consumption of the refractory materials lining the various containers.

In general, this increased control of the temperature makes it easier to obtain a temperature of the steel in the tundish relatively close to the liquidus temperature of the casting grade. The difference between these two temperatures is called "superheat". From a metallurgisal point of view, a small temperature difference helps to obtain a solidified product that in section has little segregation of alloy elements such as carbon, manganese and sulphur, thereby achieving good homogeneity of its mechanical properties. This advantage is particularly important when casting grades of steel with high alloy element content. In addition, a small temperature difference enables the product solidification time to be reduced: this makes it possible to cast the product at a higher speed, leading to increased productivity of the foundry, or to construct a relatively continuous casting machine, thereby reducing the investment.

A first method of supplying heat to the metal passing through the tundish consists in making at least part of said metal flow inside a channel surrounded by a coil with appropriate characteristics, the currents induced in the metal causing it to be heated by the Joule effect. This solution is relatively expensive and the size of the coil makes it difficult to apply to small installations, or installations not initially designed to be so equipped.

Another solution consists in installing above the metal in the tundish one or even several plasma torches. Document WO 95/32069 in particular describes a tundish so equipped. It will be recalled that the operating principle of a plasma torch consists in blowing onto the material to be heated a gas under pressure (plasma gas), such as nitrogen or argon, through which an electric arc created between a cathode and an anode is passed. The gas is thus partially ionised and is heated to a very high temperature (4000 to 15000 K). It possesses very high thermal conductivity and radiation power which make it suitable for performing fast, intense heat exchanges with the material to be heated. By varying the pressure of the gas and the intensity of the current, it is easy to obtain the powers of several hundred kW needed for heating the steel in the tundish using a torch that is small enough to be installed even on a small tundish. Two designs of torch are used for this application. In "injection" plasma torches the cathode and anode are both incorporated in the torch. In "transferred arc" plasma torches, only the cathode is incorporated in the torch, the anode being formed by the molten metal to be heated. For this purpose, the base of the tundish encloses an electrically conducting element which is brought into contact with the molten metal during casting and connected to the positive terminal of the electric power supply of the torch. It is also possible to use the reverse polarities to those previously described.

The area of the tundish in which the torch is located must be covered by a cover with a refractory lining. This cover, under which an inert gas such as argon can be blown in addition to the plasma gas (or to replace it during periods when the torch is not in use), makes it possible to keep an atmosphere practically free from oxygen in the vicinity of the torch, which therefore does not pollute the molten metal. It also prevents rays from the arc dazzling personnel working on the installation. In addition, it is imperative that the torch act on the bare molten metal, which must therefore not be covered with the thermal insulation powder which it is normal to spread over its surface to protect it from atmospheric reoxidation and to prevent radiation from it.

The refractory materials lining the tundish receive a significant portion of the radiation of the arc emitted by the torch, and because of this their surface is heated to very high temperatures, which can exceed 1800° C. when the torch is used at high power. At these temperatures, magnesium or alumina, which are the materials usually used, reach their melting point and the linings quickly deteriorate. In addition, the refractory material turning to liquid tends to flow over the surface of the metal bath, where it forms an insulating crust which impedes heat transfer between the plasma and the metal, and can even turn off the arc (in the case of a transferred arc plasma torch). It is therefore essential to find an operating point of the torch which achieves a compromise between adequate heating of the metal and tolerable deterioration of the refractory materials, which is to the detriment of the heating efficiency that the torch could theoretically offer.

It is possible to consider making the lining of the tundish in a refractory material with a melting temperature still higher than the conventional materials, for example silicon carbide or a ceramic. But since the lining of the tundish must be completely renewed between each casting or between each sequence, this would considerably increase the cost of operating the installation and would largely cancel out the economic advantages provided by the torch.

In addition, any improvement in the geometry of the tundish that would increase the thermal efficiency of the heating arc would of course be desirable.

OBJECT OF THE INVENTION

The purpose of the invention is to propose an economic means for limiting deterioration of the refractory lining of the tundish in the plasma torch's action area, without compromising, and even increasing, the efficiency with which this same torch heats the metal.

DETAILED DESCRIPTION OF THE INVENTION

To this end, the invention consists in a method of heating a molten metal in a continuous casting tundish using a plasma torch installed in said tundish, characterised in that said molten metal is made to flow along the internal walls of a heating compartment formed inside said tundish, the end of said plasma torch being positioned above the level of the molten metal contained in said heating compartment in such a way that the electric arc generated by said plasma torch radiates over the molten metal flowing along said walls of said compartment.

The invention also consists in a tundish for continuous casting of a molten metal of the type comprising a plasma torch for heating the molten metal, a cover through which said torch passes and casting nozzles formed in the bottom of the tundish, characterised in that it comprises at least one heating compartment made of refractory material positioned below said plasma torch, means for filling said heating compartment with molten metal by said metal flowing along the internal walls of said tundish, and means for bringing the heated molten metal to the casting nozzles.

The invention consists in creating a layer of molten metal along the internal walls of the compartment in which the molten metal is heated by the plasma torch. This layer of molten metal flowing along the walls has the advantage of protecting the refractory material forming said heating compartment from the radiation from the electric arc of the plasma torch. The refractory material protected in this way is not subjected to direct radiation from the arc and cannot be heated to its melting point. The refractory material has a longer life and the molten metal in the heating compartment is not polluted by any seepage of melted refractory material.

In addition, another advantage of the invention is that the direct radiation of the arc onto the molten metal flowing along the walls of the heating compartment increases the thermal efficiency of the plasma torch, since in this way practically all of the molten metal passing through the tundish passes in front of the arc of the torch, which radiates directly onto them.

BRIEF DESCRIPTION OF THE DRAWINGS

The invention will be better understood by reading the following description, given with reference to the accompanying drawings:

FIGS. 1*a* and 1*b* show a prior art tundish 1 for continuous casting of metal. In the example shown, which of course is not limitative, it can feed a continuous casting machine (not shown) equipped with two moulds. It comprises an outer metal casing 2, lined with a refractory material 3. The space inside the tundish 1 has a shape which widens outwards towards the top to make it easy to remove the refractory lining 1 after casting simply by turning over the tundish 1. The molten metal 4 (not shown in FIG. 1*a*) enters the tundish 1 from a ladle not shown, and is introduced through the intermediary of a refractory material pipe 5 connected to the outlet orifice of the ladle. This pipe 5 protects the molten metal 4 which passes through it from atmospheric reoxidation. The molten metal 4 is emptied into the moulds (not shown) through nozzles 6, 6'. Refractory material pipes 7 connected to the nozzles 6, 6' protect the molten metal 4 from atmospheric reoxidation as it passes between the tundish 1 and the mould corresponding to each nozzle 6, 6'.

Figure 1A:
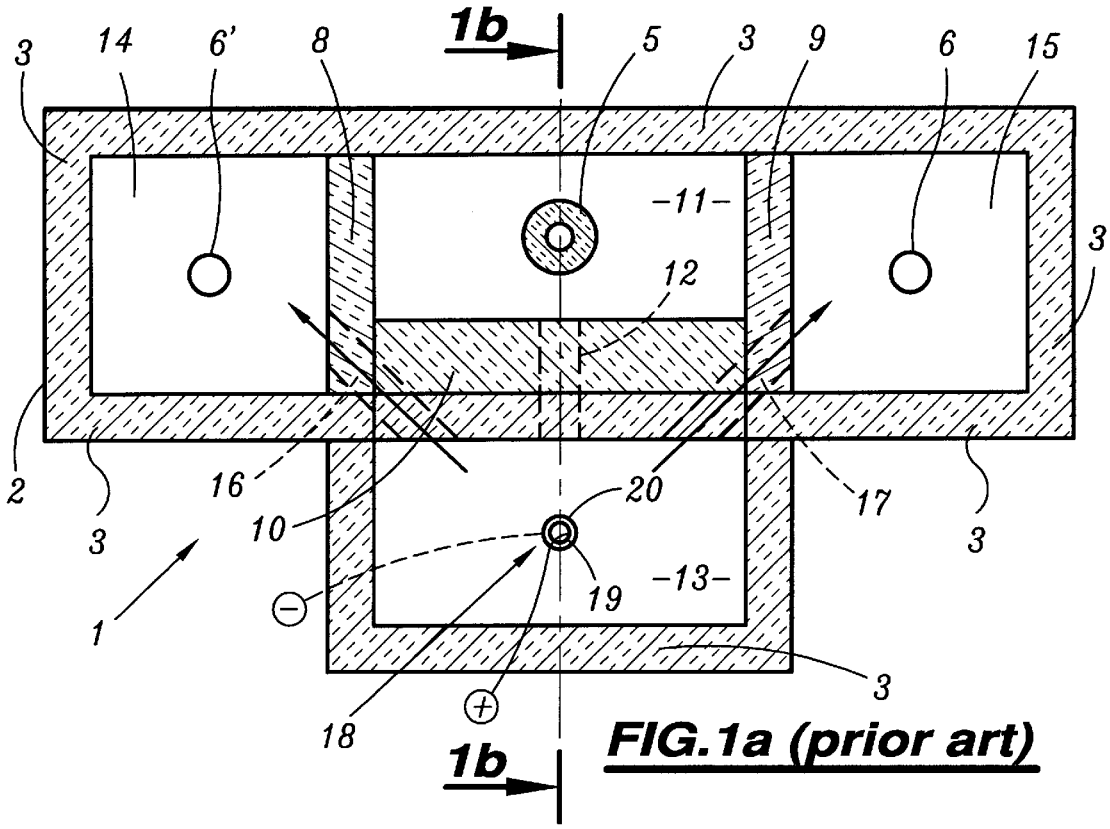
FIG.1a (prior art)
FIGS. 1*a* and 1*b* show respectively from above and in cross-section taken along the line Ib—Ib an example of a tundish for continuous casting of steel according to the prior art.

The tundish 1 shown by wave of example is of generally rectangular shape and is divided internally into four compartments by refractory partitions 8, 9, 10. Two partitions 8, 9 are at right angles to the larger sides of the tundish 1 and the partition 10 is parallel to the larger sides of the tundish and links the other two partitions 8, 9. The partitions 8, 9, 10 delimit a first compartment 11 receiving the molten metal 4, into which the pipe 5 connected to the ladle leads. The molten metal 4 then passes through the partition 10 via a pipe 12 into a second compartment 13, which in the example shown forms a lateral protuberance of the tundish 1 located opposite the inlet pipe 5 for the molten metal 4. As can be seen, it is in this second compartment 13 that the molten metal 4 is heated. It then passes into the third and fourth compartments 14 and 15 through pipes 16, 17 which pass through the walls 8, 9, 10. It is in these compartments 14, 15 that the nozzles 6, 6' overhanging the moulds of the continuous casting machine are located.

The device for heating the molten metal 4 comprises a torch 18 of a type known in itself. Schematically, it comprises a cathode 19 in a material such as thoriated tungsten connected to the negative pole of the generator supplying the torch and surrounded by a metal (e.g. copper) jacket 20 which can act as the anode. If the torch 19 is of the transferred arc plasma type, as in the example shown, the metal jacket 20 behaves as an anode only on ignition of the arc; but if the torch is of the injection type, this metal jacket 20 is permanently connected to the positive pole of the generator supplying the torch. The plasma gas, which can be argon or in some cases nitrogen if the grade of steel cast can tolerate a relatively high nitrogen content, is injected between the jacket 20 and the cathode 19. In the base 21 of the tundish 1 is located an anode 22 consisting, for example, of a steel bar cooled over at least part of its length and connected to the positive pole of the generator supplying the torch. Between the cathode 19 and the molten metal 4 which is in contact with the anode 22 there is therefore created an electric arc 23 through which the plasma gas passes, so as to heat the molten metal 4 present in the second compartment 13 which is referred to hereinafter as the "heating compartment".

So that the electric arc 23 does not dazzle anyone working close to the casting machine, it is necessary to place a cover 24 (not shown in FIG. 1*a*) over the heating compartment 13, the cover being lined with a refractory layer 25 through which the torch 18 passes. In addition, this cover 24 enables the atmosphere surrounding the heating compartment 13 to be confined by sheltering it from the outside atmosphere and enabling the argon injected by the torch 18 to be kept above the molten metal 4. This avoids atmospheric reoxidation which would otherwise inevitably occur, and more so because in this heating compartment 13 it is not possible to cover the surface of the molten metal 4 with an insulating powder, which would impede thermal and electrical transfers between the torch 18 and the metal 4. Such a powder 26 is present on the surface of the molten metal 4 in the other compartments 11, 14, 15 of the tundish. At least during periods when the torch 18 is not used, it is also possible to inject argon under the cover 24 through an orifice 27.

As has been stated, with a tundish configured in this way radiation of the electric arc 23 causes rapid wear of the exposed part of the refractory material 3 covering the tundish 1 in the heating compartment 13. This wear can eventually lead to surface melting, with all the problems previously mentioned that this entails. It would therefore be necessary to make all of the refractory parts exposed to the arc 23 of a material presenting very high resistance to its radiation, which would entail additional costs that would be difficult to accept.

Figure 1B:
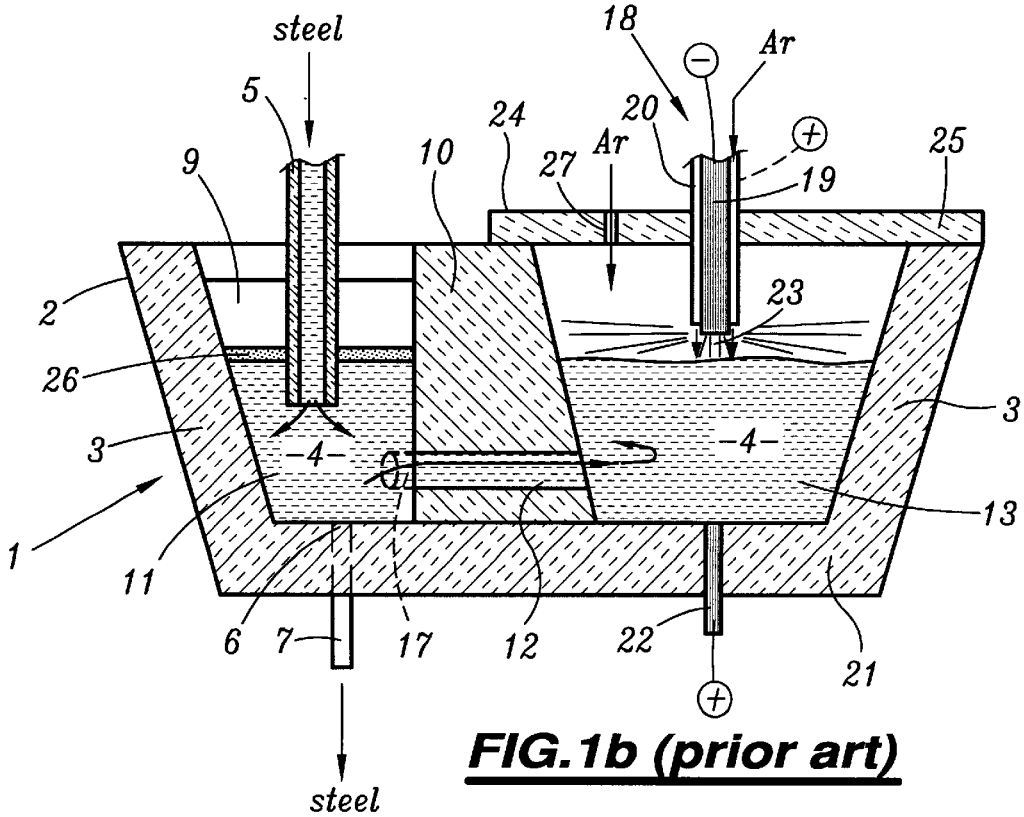
FIG.1b (prior art)
Figure 2A:
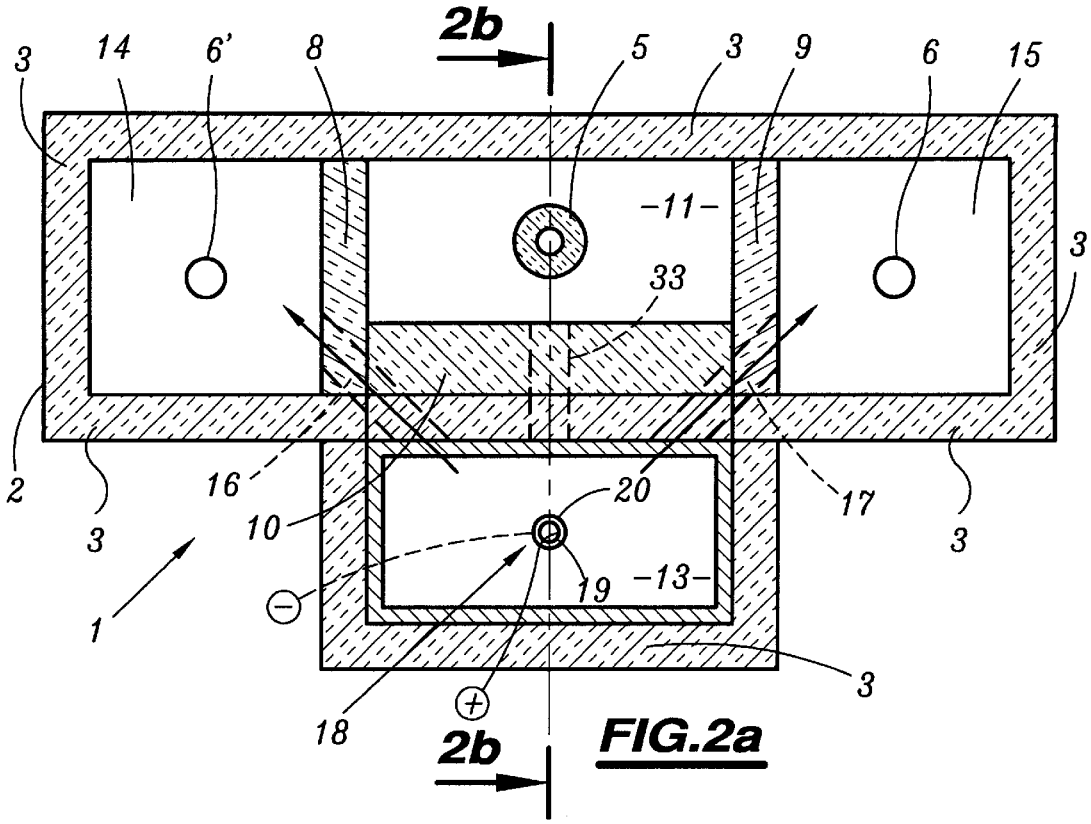
FIGS. 2*a* and 2*b* show from above and in cross-section taken along the line IIb—IIb the same tundish, modified according to a first variant of the invention.
Figure 2B:
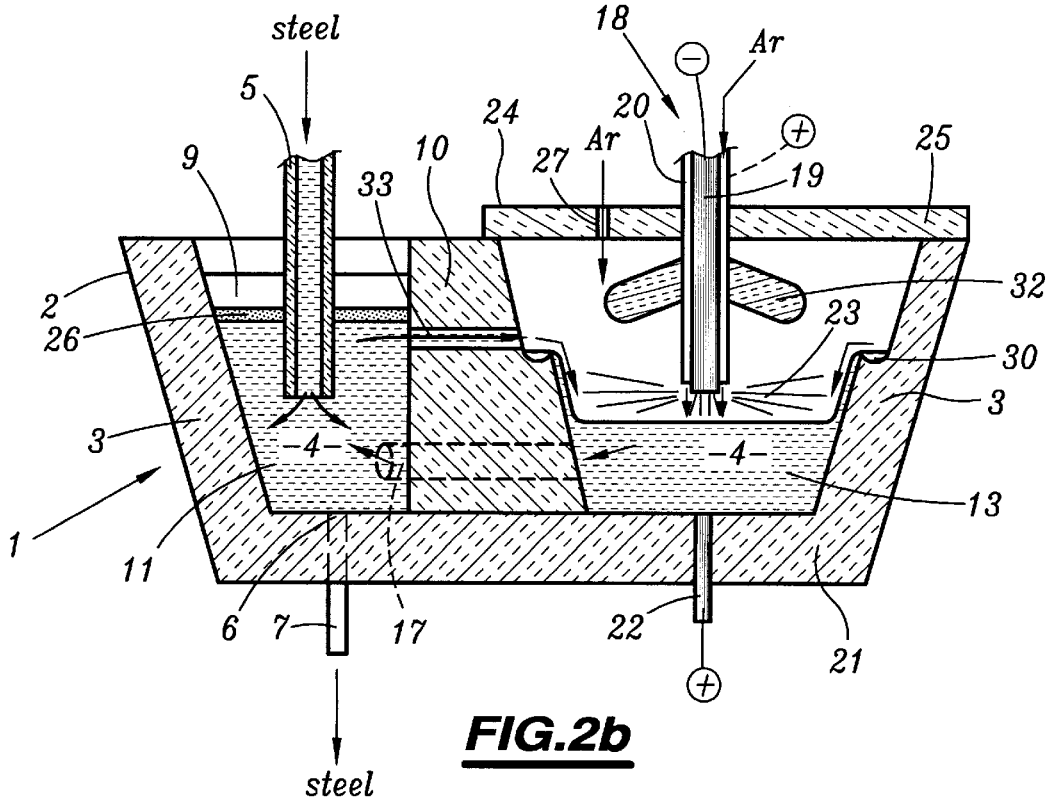

The tundish according to the invention shown in FIGS. 2*a* and 2*b* is an improvement on the previous tundish (their common parts are denoted by the same references as in FIGS. 1 and 2), in which the above problem is solved economically. For this purpose, the heating compartment 13 comprises a peripheral channel 30 formed on the upper edge of said heating compartment 13 and entirely surrounding said compartment 13. The molten metal 4 contained in the inlet compartment 11 passes through the partition 10 separating the two compartments via a pipe 33 passing through said partition 10. This pipe 33 passes through the partition 10 just below the level of the layer of insulating powder 26 covering the surface of the molten metal 4 and protecting it from atmospheric oxidation in the molten metal inlet compartment 11, and exits level with the channel 30 of the heating compartment 13. The molten metal 4 is thus distributed around the periphery of the heating compartment 13 in the channel 30. The inlet compartment 11 is fed with a flow of molten metal 4 sufficient to make the molten metal 4 in the channel 30 overflow. Uniform flow of said molten metal 4 along the internal walls of the heating compartment 13 is achieved by this overflow effect. The thickness of the layer of molten metal 4 along the internal walls of the heating compartment 13 is optimally of the order of 1 mm to 2 mm to achieve both good protection of the refractory materials 3 against radiation from the arc 23 and good thermal transfer efficiency. The heating compartment 13 has a diameter of approximately 0.6 m and if the molten metal 4 travels at the rate of 2.4 rpm with an initial temperature of 1550° C., it can be calculated that an increase of temperature in the molten metal 4 of up to approximately 20° C. could be achieved with conventional plasma torches.

Also to avoid the refractory material 25 lining the cover 24 being quickly worn by radiation from the electric arc 23 of the plasma torch 18, a baffle 32 of refractory material is preferably attached to said cover 24 and surrounds said plasma torch 18.

Figure 3A:
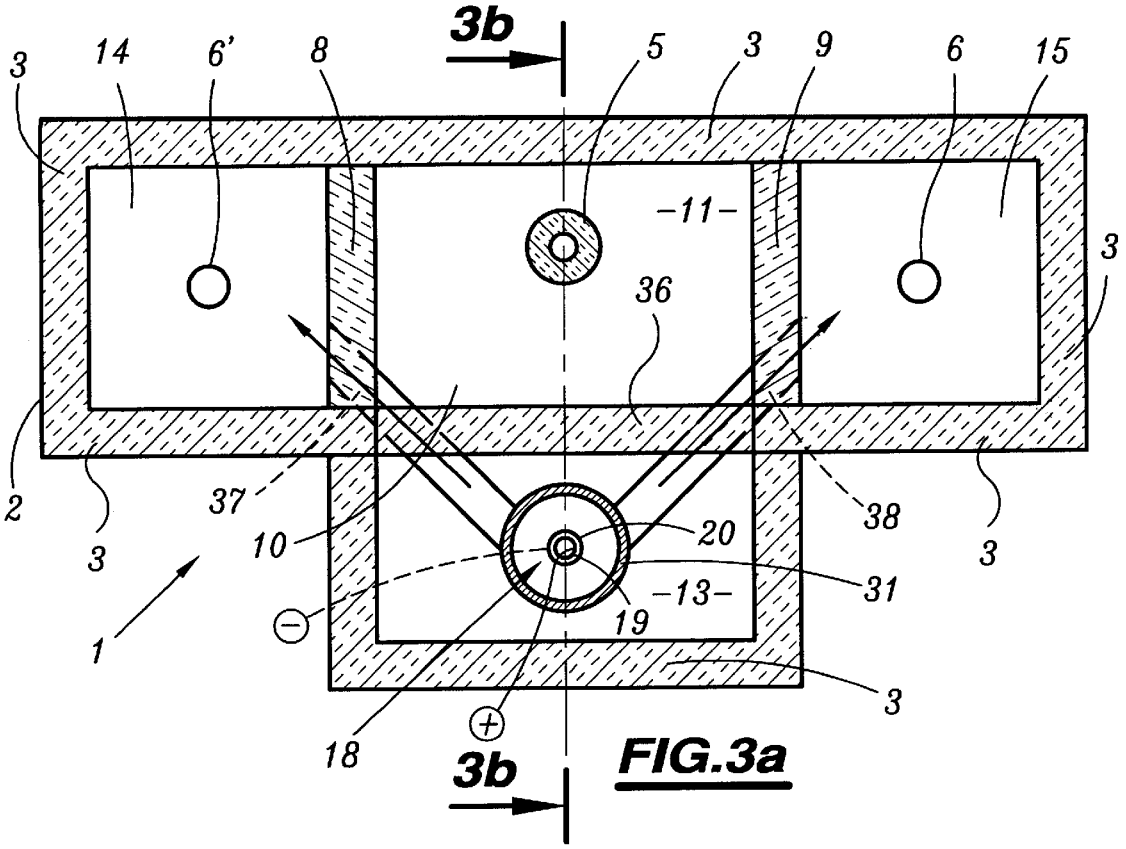
FIGS. 3*a* and 3*b* show from above and in cross-section taken along the line IIIb—IIIb a second variant of the tundish according to the invention.
Figure 3B:
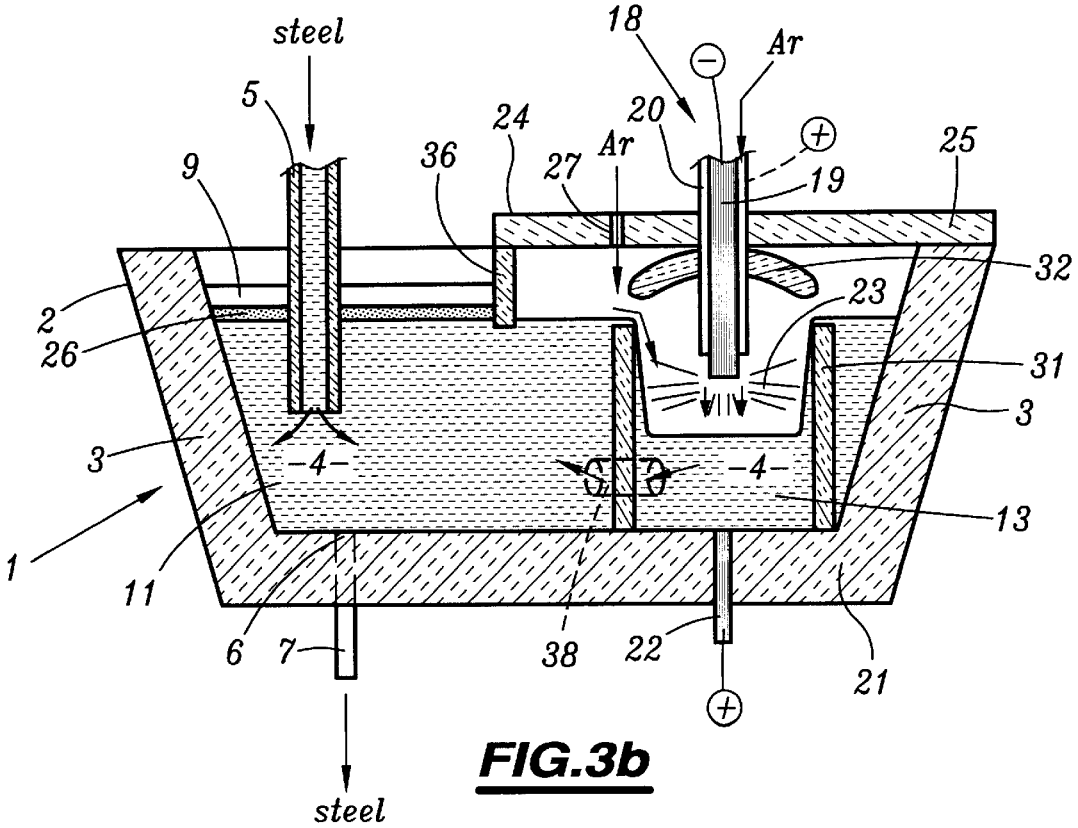

The tundish 1 according to the invention shown in FIGS. 3*a* and 3*b* constitutes a second embodiment of the invention. The heating compartment 13 consisting of a cylinder 31 of refractory material is Installed in an area of the molten metal 4 inlet compartment 11. The nozzle of the plasma torch 18 penetrates into the cylinder 31 a distance of approximately 0.2 m from the level of the molten metal 4 contained in said cylinder 31. Its upper end is just below the nominal level of the molten metal 4 and just below the plasma torch 18. Thus the molten metal 4 in the molten metal inlet compartment 11 enters the heating compartment 13 by overflowing and flowing along the internal walls of the cylinder 31 forming said heating compartment 13. Once heated, the molten metal 4 flows into the casting compartments 14, 15 along the pipes 37, 38 that connect them to the heating compartment 13. These pipes rest on the bottom of the inlet compartment 11 and pass through the partitions 8, 9.

The surface of the molten metal 4 in the inlet compartment 11 is covered with a layer of insulating powder 26 designed to protect said molten metal 4 from atmospheric oxidation. This insulating powder 26 would impede thermal and electrical transfer between the plasma torch 18 and said molten metal 4. A barrier 36 designed to retain said insulating powder 26 transversely bars the upper part of the inlet compartment 11 over the path of the molten metal 4 towards the heating compartment 13. This barrier 36 consists of a plate of refractory material.

As in the first variant of the invention, a removable refractory material baffle 32 is preferably attached to the refractory material cover 24 and surrounds the plasma torch 18.

It is evident that the tundishes described and shown are merely examples of embodiments of the invention which can easily be adapted to other types of continuous metal casting tundishes.

I claim:

1. A method of heating molten metal in a continuous casting tundish comprising a heating compartment formed inside said tundish having walls of which internal surfaces contact the molten metal and a plasma torch installed in said heating compartment and having an end from which an electric arc is generated positioned above a level of the molten metal in said heating compartment, said method comprising:

causing the molten metal to flow along at least a part of said internal surfaces of said heating compartment walls facing towards the end of the plasma torch, generating an electric arc between said end of said plasma torch and said level of the molten metal, wherein the electric arc radiates over the molten metal flowing along said part of said internal surfaces.

2. The method according to claim 1 comprising making the molten metal flow and feeding said heating compartment with the molten metal by overflowing the molten metal from an inlet compartment of the tundish into which said molten metal is fed from a poring ladle.

3. A tundish for continuous casting of a molten metal comprising a plasma torch for heating the molten metal, a cover through which said torch passes and casting nozzles formed in the bottom of the tundish, and further comprising at least one heating compartment having walls made of refractory material in which said plasma torch is positioned, means for feeding said heating compartment with molten metal by causing said metal to flow along internal surfaces of walls of said heating compartment, and means for bringing the heated molten metal to the casting nozzles.

4. The tundish for continuous casing of molten metal according to claim 3, comprising a refractory material partition which divides it into at least two compartments, a first compartment being an inlet compartment for the molten metal and a second compartment being the at least one heating compartment, and a pipe which passes through said partition and enables the molten metal to pass into a channel formed on an upper peripheral part of said walls of said heating compartment, and enabling the molten metal to overflow along the internal walls of said heating compartment.

5. The tundish for continuous casing of metal according to claim 4, wherein the walls of the at least one heating compartment consist of a refractory material cylinder a top end of which is located at a level just below a nominal level of the molten metal in the inlet compartment.

* * * * *